US008361241B2

(12) United States Patent
Sone et al.

(10) Patent No.: US 8,361,241 B2
(45) Date of Patent: Jan. 29, 2013

(54) WASHING APPARATUS FOR WASHING A HEAD PORTION OF A DEPILATION APPARATUS

(75) Inventors: Daisuke Sone, Otsu (JP); Fumio Taniguchi, Moriyama (JP); Yasuhide Matsuoka, Hikone (JP)

(73) Assignee: Panasonic Corporation, Osaka (JP)

( * ) Notice: Subject to any disclaimer, the term of this patent is extended or adjusted under 35 U.S.C. 154(b) by 406 days.

(21) Appl. No.: 12/684,330

(22) Filed: Jan. 8, 2010

(65) Prior Publication Data

US 2010/0175723 A1 Jul. 15, 2010

(30) Foreign Application Priority Data

Jan. 15, 2009 (JP) ..... 2009-006830

(51) Int. Cl.
*B08B 3/04* (2006.01)

(52) U.S. Cl. ..... 134/169 R; 134/111; 134/186

(58) Field of Classification Search ..... 68/166 R, 68/169, 111
See application file for complete search history.

(56) References Cited

U.S. PATENT DOCUMENTS

| | | | | |
|---|---|---|---|---|
| 5,649,556 | A * | 7/1997 | Braun | 134/92 |
| 5,711,328 | A | 1/1998 | Braun | |
| 7,150,285 | B2 * | 12/2006 | Saito et al. | 134/100.1 |
| 2002/0069902 | A1 | 6/2002 | Hoser et al. | |
| 2002/0170583 | A1 | 11/2002 | Wong | |
| 2004/0154650 | A1 | 8/2004 | Saito et al. | |
| 2005/0126611 | A1 | 6/2005 | Eichhorn et al. | |
| 2008/0016693 | A1 * | 1/2008 | Nakayama et al. | 30/41.5 |
| 2009/0031566 | A1 | 2/2009 | Kitamura | |

FOREIGN PATENT DOCUMENTS

| | | | |
|---|---|---|---|
| DE | 29821739 | | 2/1999 |
| EP | 0664973 | | 8/1995 |
| EP | 1880632 | | 1/2008 |
| FR | 2695668 | | 3/1994 |
| JP | 54-119768 | * | 9/1979 |
| JP | 64-057624 | * | 3/1989 |
| JP | 04-104871 | * | 4/1992 |
| JP | 2000-015194 | * | 1/2000 |
| JP | 3652393 | | 3/2005 |
| JP | 2005-312489 | | 11/2005 |

OTHER PUBLICATIONS

Search report from E.P.O., mail date is Sep. 2010.
English language Abstract of JP 7-236514.

* cited by examiner

*Primary Examiner* — Frankie L Stinson
(74) *Attorney, Agent, or Firm* — Greenblum & Bernstein, P.L.C.

(57) ABSTRACT

In a washing apparatus for washing a head portion of a depilation apparatus, it enables to increase design freedom of pipe arrangement from an overflow prevention unit to a washing fluid tank and to downsize the apparatus by effectively utilizing a space below the overflow prevention unit. A tray for holding a head portion of the electric shaver and an overflow preventing unit to maintain fluid level of the washing fluid in the tray at a predetermined level are integrally formed to adjoin each other via a partition wall in an anteroposterior direction of the washing apparatus. A bottom face of the overflow prevention unit is inclined downward in a widthwise direction of the washing apparatus, and an outlet is provided on a side wall in the widthwise direction in a deepest portion of the overflow prevention unit. A second exhausting path for exhausting the washing fluid from the outlet of the overflow preventing unit is arranged along a side wall of the tray.

17 Claims, 6 Drawing Sheets

(b)

(a)

WASHING APPARATUS FOR WASHING A HEAD PORTION OF A DEPILATION APPARATUS

BACKGROUND OF THE INVENTION

1. Field of the Invention

The present invention relates to a washing apparatus which washes a head portion of a depilation apparatus such as an electric shaver.

2. Description of the Related Art

A washing apparatus for washing a head portion of a depilation apparatus such as an electric shaver comprises a tray which contains a head portion of the electric shaver or the like, and washes the head portion by circulating a washing fluid between the and a washing fluid tank by a pump. While washing the head portion, the pump supplies the washing fluid to the tray from the tank through a supplying path and returns the washing fluid from the tray through an exhausting path.

A conventional washing apparatus shown in Japanese Patent No. 3,652,393 comprises a tray, a washing fluid tank disposed below the tray and an overflow prevention unit which is provided to enclose the tray and returns the washing fluid overflowing the tray to the tank. An exhausting pipe through which the washing fluid is exhausted is provided on a bottom ob the tray, but the exhausting pipe is closed while washing the head portion of the electric shaver. On the other hand, the washing fluid is continually supplied from the tank to the tray, so that the washing fluid which overflows a side wall of the tray returns to the tank through the overflow prevention unit.

When the washing fluid is provided just below the tray and the overflow prevention unit, the configuration of the washing apparatus becomes simple, but the relations between relative positions of the tray, the overflow prevention unit and the washing fluid tank are limited, and thus design freedom becomes smaller. In addition, the dirty washing fluid including beard chips directly flows into the washing fluid tank so that deterioration of the washing fluid is significant. Moreover, if it is tried to provide a filter between the exhaust pipe provided on the bottom of the tray and the overflow prevention unit and the washing fluid tank to prevent the deterioration of the washing fluid, it causes the upsizing of the apparatus. Furthermore, when the washing fluid tank is provided at a position other than just below the tray and the overflow prevention unit, it is necessary to couple the exhaust pipe provided on the bottom of the tray and the overflow prevention unit at any position and to connect the coupling portion and the washing fluid tank by inflected pipe arrangement, and thus, flowability of the washing fluid becomes worse due to resistance of the pipe arrangement. Therefore, power of the pump must be increased which causes upsizing and cost rising of the apparatus.

SUMMARY OF THE INVENTION

The present invention is conceived to solve the above mentioned problems and purposes to provide a washing apparatus for washing a head portion of a depilation apparatus which enables to increase design freedom of pipe arrangement from an overflow prevention unit to a washing fluid tank and to downsize the apparatus by effectively utilizing a space below the overflow prevention unit.

A washing apparatus for washing a head portion of a depilation apparatus in accordance with an aspect of the present invention comprises:

a tray for holding a head portion of the depilation apparatus;

a washing fluid tank for containing a washing fluid;

a supplying path through which the washing fluid is supplied from the tank to the tray;

a first exhausting path for exhausting the washing fluid from an exhausting spout of the tray;

an overflow preventing unit which is connected to the tray to maintain fluid level of the washing fluid in the tray at a predetermined level;

a second exhausting path for exhausting the washing fluid flowing into the overflow preventing unit from an outlet of the overflow preventing unit; and a pump for supplying the washing fluid in the tank to the tray through the supplying path and returning the washing fluid exhausted through the first exhausting path and the second exhausting path to the tank, wherein the outlet of the overflow preventing unit is provided on a side wall in a widthwise direction of the washing apparatus; and the second exhausting path is arranged along a side wall of the tray in the widthwise direction of the washing apparatus.

According to the above mentioned configuration, it is no need to provide any pipe arrangement below the overflow prevention unit, so that design freedom in structure of the washing apparatus is increased and the pump and so on can be disposed in the space below the overflow prevention unit for enabling downsizing of the washing apparatus.

DETAILED DESCRIPTION OF THE EMBODIMENT

Figure 1:
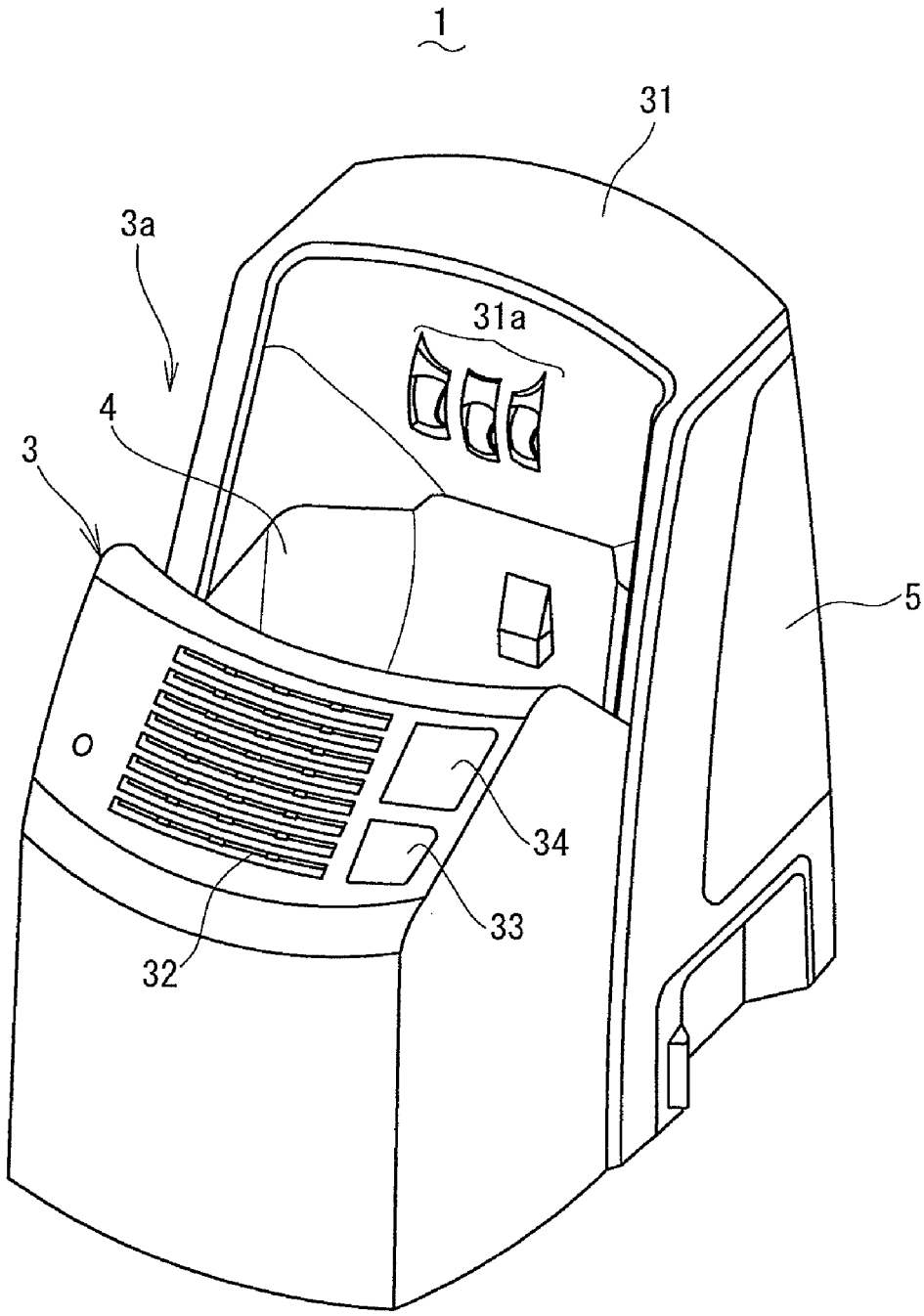
FIG. 1 is a perspective view showing a configuration of a washing apparatus for washing a head portion of a depilation apparatus in accordance with an embodiment of the present invention.
Figure 2:
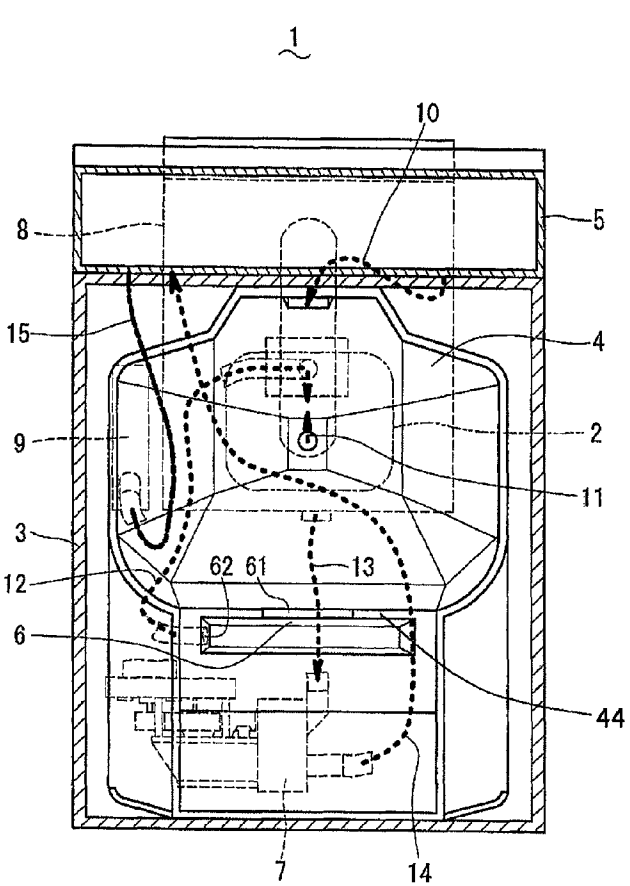
FIG. 2A is a sectional side view showing the configuration of the washing apparatus.
FIG. 2B is a sectional plain view along I-I line in FIG. 2A.
Figure 2:
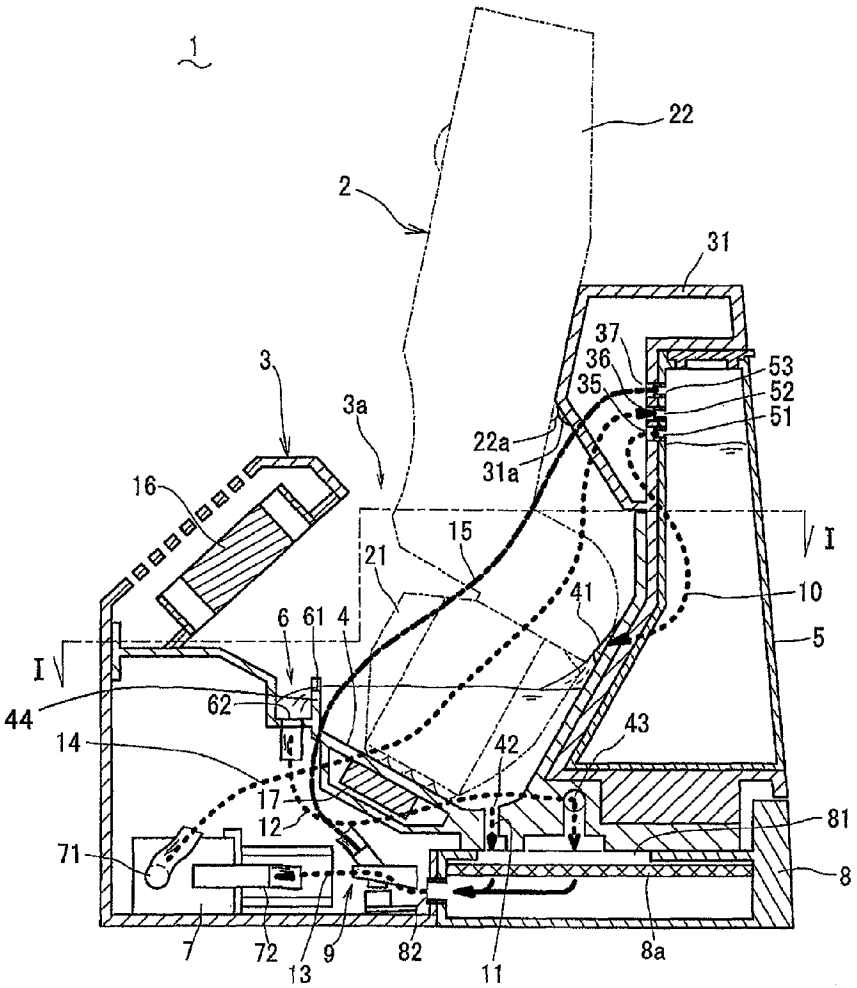

A washing apparatus for washing a head portion of a depilation apparatus in accordance with an embodiment of the present invention is described with reference to attached drawings. FIG. 1 shows an appearance of the washing apparatus 1, FIG. 2A shows a side-sectional configuration of the washing apparatus 1, and FIG. 2B shows a plain-sectional configuration of the washing apparatus 1 along I-I line in FIG. 2A.

The washing apparatus 1 is used to wash a head portion 21 of an electric shaver 2 which is a kind of a depilation apparatus, and comprises a housing 3 having an opening 3*a* through which the head portion 21 of the electric shaver 2 is inserted in a state that the head portion 21 is oriented downward, and a tray 4 which holds the head portion 21 inserted through the opening 3*a*.

The washing station 1 further comprises a washing fluid tank 5 which contains a washing fluid, an overflow prevention unit 6 which is connected to the tray 4, a pump 7 which circulatory supplies the washing fluid from the tank 5 to the tray 4, a filter cartridge 8 having a filter 8*a* to leach the washing fluid, a switching valve 9 for controlling pressure in the tank 5 and a circulation path for circulating the washing fluid. The circulation path is configured by a supplying path 10 to supply the washing fluid in the tank 5 to the tray 4, a first exhausting path 11 to guide the washing fluid exhausted from the tray 4 to the filter cartridge 8, a second exhausting path 12 to guide the washing fluid exhausted from the overflow prevention unit 6 to the filter cartridge 8, a first returning path 13 to guide the washing fluid exhausted from the filter cartridge 8 to the pump 7, and a second returning path 14 to guide the washing fluid discharged from the pump 7 to the tank 5. In addition, an airtight path 15 is connected to the tank 5 through the switching valve 9. The supplying path 10, the first exhausting path 11, the second exhausting path 12, the first returning path 13, the second returning path 14 and the airtight path 15 are formed of flexible resin tubes, for example. Details of each component are described below.

The housing 3 has a stand 31, which contacts a gripper 22 of the electric shaver 2, at rear portion and holds the electric shaver 2 inserted through the opening 3*a* with the tray 4. A plurality of electric contacts 31*a* is provided on a front face of the stand 31. The electric contacts 31*a* have a function to detect that the electric shaver 2 is mounted on this washing apparatus 1 by contacting terminals 22*a* provided at a rear face of the gripper 22 of the electric shaver 2 and further has a function to charge a secondary battery of the electric shaver 2. In addition, it is preferable that the electric contacts 31*a* further have a function to transmit a predetermined control signal to drive a built-in motor of the electric shaver 2 in washing operation. A fan 16 for generating air flow to dry the head portion 21 of the electric shaver 2 after washing is provided in an upper front portion of the housing 3. In addition, a ventilation window 32 for the fan 16, an operation switches 33 to start washing operation by the washing apparatus 1, an indication lamp 34 to indication operation state, and so on are provided on a front face of the housing 3. A rear end portion of the housing 3 serves as a mounting base on which the washing fluid tank 5 is mounted, and coupling plugs 35, 36 and 37 are provided on the mounting base to be coupled with openings 51, 52 and 53 of the tank 5. The coupling plug 35 is connected to the supplying path 10, the coupling plug 36 is connected to the second returning path 14, and the coupling plug 37 is connected to the airtight path 15.

The tray 4 has a concave shape following to a convex shape of the head portion 21 of the electric shaver 2. A washing fluid supplying spout 41 connected to the supplying path 10 is provided on a rear wall of the tray 4, and an exhausting spout 42 connected to the first exhausting path 11 is provided on a bottom wall of the tray 4. A heater 17 is further provided on a rear face of the bottom wall of the tray 4, which is used with the fan to dry the head portion 21 of the electric shaver 2.

The overflow prevention unit 6 is established in front of the tray 4, and the tray 4 and the overflow prevention unit 6 are integrally formed in this embodiment. The overflow prevention unit 6 maintains fluid level of the washing fluid in the tray 4 at a constant level to prevent overflow of the washing fluid from the tray 4 or the housing 3. An inlet 61 of the overflow prevention unit 6 is connected to the tray 4 and an outlet 62 of the overflow prevention unit 6 is connected to the second exhausting path 12. The second exhausting path 12 reaches to the filter cartridge 8 from the outlet 62 of the overflow prevention unit 6 via a transit section 43 which is provided at lower rear portion of the tray 4.

The tank 5 is detachably provided on the rear end portion of the housing 3, and has a discharge opening 51, an inflow entrance 52 and a breather 53 which are formed on the front face thereof. When the tank 5 is mounted on the housing 3, the discharge opening 51 is connected to the coupling plug 35 and further connected to the washing fluid supplying spout 41 of the tray 4 via the supplying path 10. The inflow entrance 52 is connected to the coupling plug 36 and further connected to an outlet 71 of the pump 7 via the second returning path 14. The breather 53 is connected to the coupling plug 37 and further connected to the switching valve 9 via the airtight path 15. The discharge opening 51, the inflow entrance 52 and the breather 53 are provided above the fluid level of the washing fluid to be filled in the tank 5. In addition, the breather 53 is positioned above the inflow entrance 52, and the inflow entrance 52 is positioned above the discharge opening 51.

Figure 3:
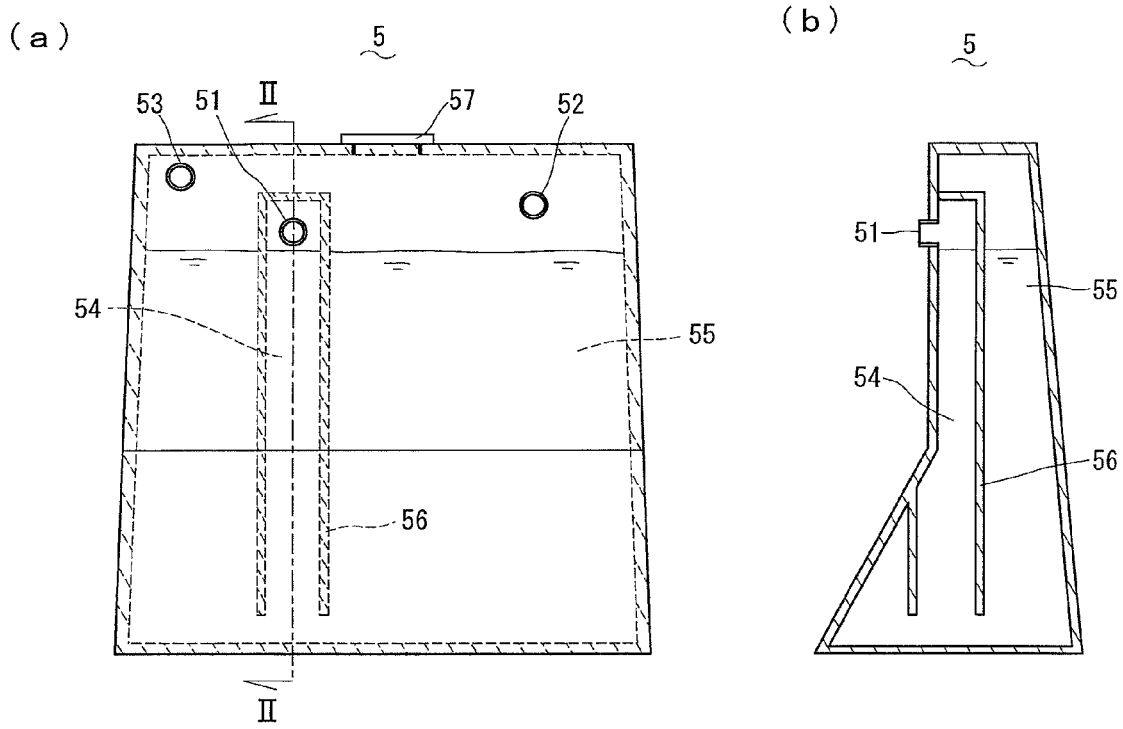
FIG. 3A is a sectional front view showing a configuration of a washing fluid tank of the washing apparatus.
FIG. 3B is a sectional side view along II-II line in FIG. 3A.

As shown in FIG. 3A and FIG. 3B, an inside of the tank 5 is sectionalized into a discharge chamber 54 which is connected to the discharge opening 51 and an inflow chamber 55 which is connected to the inflow entrance 52 and the breather 53 by a partition member 56. In addition, the discharge opening 51 and the inflow chamber 55 are connected each other at a position below the fluid level of the washing fluid to be filled in the tank 5. A spout (not illustrated) is provided on a top face of the tank 5 and the spout is sealed by a detachable cap 57.

The filter cartridge 8 is a box containing the filter 8*a* therein, and has an inflow entrance 81 provided on a top face and an outflow exit 82 provided on a front face. In addition, the filter cartridge 8 is detachably attached to a rear bottom portion of the housing 3 and located at the back of the overflow prevention unit 6. When the filter cartridge 8 is attached to the housing 3, the inflow entrance 81 is connected to the exhausting spout 42 via the first exhausting path 11 and further connected to the outlet of the overflow prevention unit 6 via the second exhausting path 12. In addition, the outflow exit 82 is connected to a suction port 72 of the pump 7 via the first returning path 13.

Figure 4:
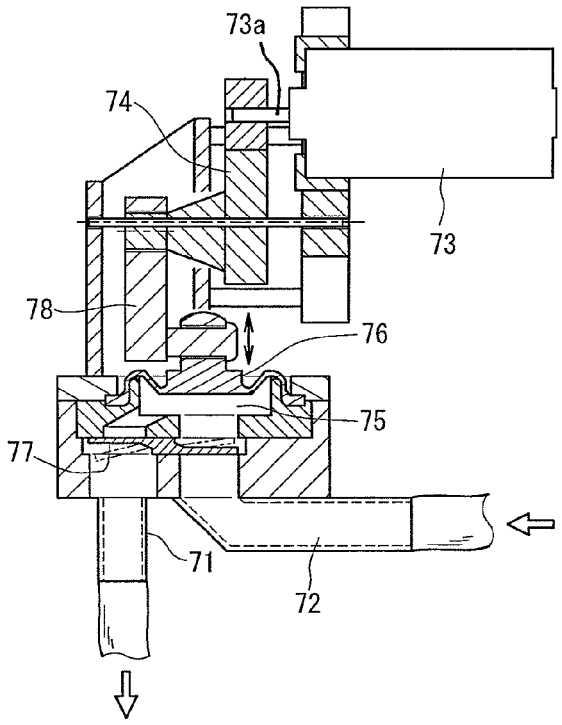
FIG. 4 is a sectional plain view showing a configuration of a pump of the washing apparatus.

The pump 7 is used to convey fluid and air, and sucks the washing fluid and air from the filter cartridge 8 via the first returning path 13 and discharges the sucked washing fluid and air to the tank 5 via the second returning path 14. Thereby, the washing fluid is circulated between the tank 5 and the tray 4. The pump 7 is provided in a space below the overflow prevention unit 6. As shown in FIG. 4, the pump 7 is configured of a diaphragm pump and comprises a motor 73, an eccentric shaft 74 which engages with an output shaft 73*a* of the motor 73, a diaphragm 76 and a valve disc 77 which define boundaries of a pump room 75, and a coupling arm 78 which couples the eccentric shaft 74 and the diaphragm 76. When the output shaft 73*a* of the motor 73 rotates, the eccentric shaft 74 performs an eccentric excursion, and the diaphragm 76 is reciprocally moved by this eccentric excursion via the coupling arm 78. Consequently, the washing fluid and air are sucked from the suction port and discharged from a discharge port 71.

Figure 5:
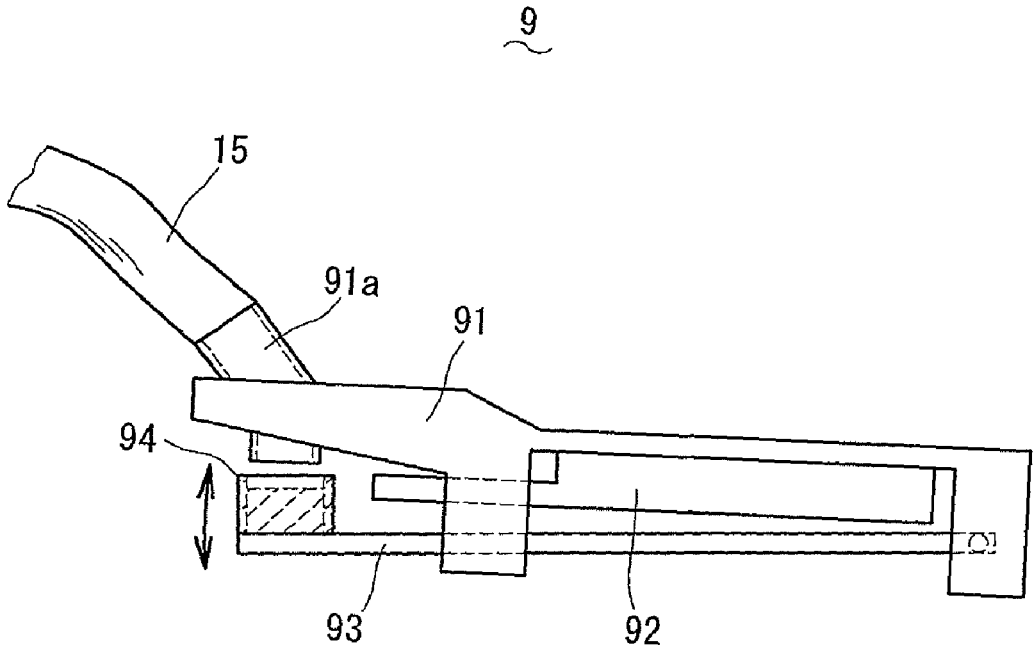
FIG. 5 is a side view showing a configuration of a switching valve of the washing apparatus.

As shown in FIG. 5, the switching valve 9 is configured of a solenoid valve and comprises a base 91 which has a pipe 91*a* connected to the airtight path 15, an electromagnet 92 fixed on the base 91, an iron piece 93 having a long plate shape and rotatably pivoted on the base 91, and a sealing member 94 which is foxed of a free end portion of the iron piece 93. According to such a configuration, when electric current is supplied to the electromagnet 92, the iron piece 93 is absorbed to the electromagnet 92, and thus, an opening of the pipe 91*a* is sealed by the sealing member 94. On the other hand, when no electric current is supplied to the electromagnet 92, the iron piece 93 departs from the electromagnet 92 by its own weight, and thus, the sealing member 94 departs from the opening of the pipe 91*a,* and consequently, air can pass through the pipe 91*a*. The switching valve 9 takes a closing state while the washing fluid has been discharged from the discharge opening 51 of the tank 5, and takes an opening state in other cases.

Figure 6:
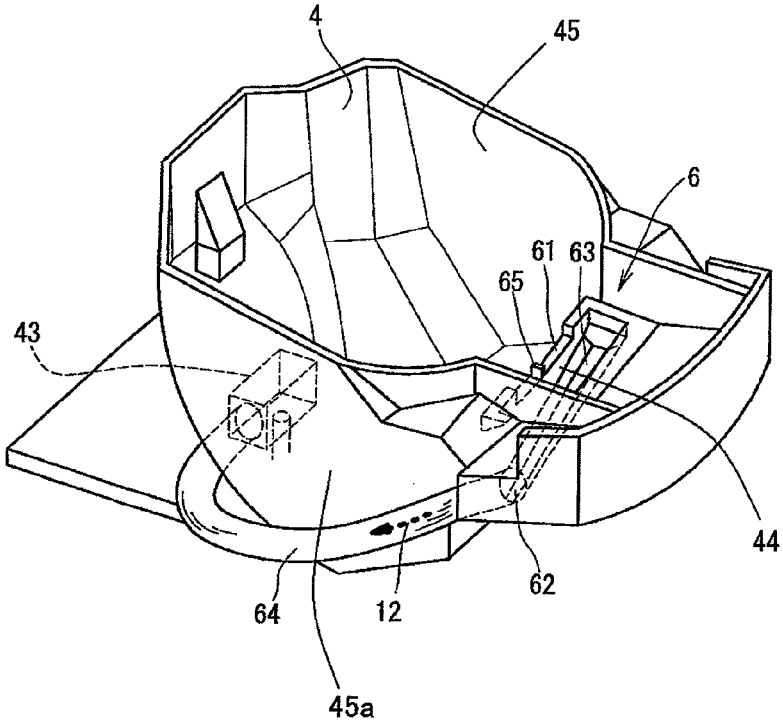
FIG. 6 is a perspective view showing a configuration of an overflow prevention unit of the washing apparatus.

As shown in FIG. 2A, FIG. 2B and FIG. 6, the overflow prevention unit 6 is integrally formed with the tray 4 so that it adjoins in front of the tray 4 via a partition wall 44 in antero-posterior direction of the washing apparatus 1. Since the electric shaver 2 shown in FIG. 2A is a type that moving blades (not shown) are reciprocally and linearly driven, the partition wall 44 is provided in parallel with the reciprocal moving direction of the moving blades when the electric shaver 2 is mounted on the washing apparatus 1. Therefore, the overflow prevention unit 6 is formed as a rectangular shape longer in widthwise direction of the washing apparatus 1 when planimetrically observed. As shown in FIG. 6, since the partition wall 44 is formed so that a height of it is lower than that of side walls 45 of other portions, when the fluid level of the washing fluid supplied to the tray 4 becomes higher than the height of the partition wall 44, the washing fluid overrides the partition wall 44 and flows into the overflow prevention unit 6 and is exhausted from the outlet 62 of the overflow prevention unit 6 to the second exhausting path 12. Thereby, the fluid level of the washing fluid in the tray 4 can be maintained at a constant level, and thus, overflow of the washing fluid from the side walls 45 of other portion can be prevented.

Figure 7:
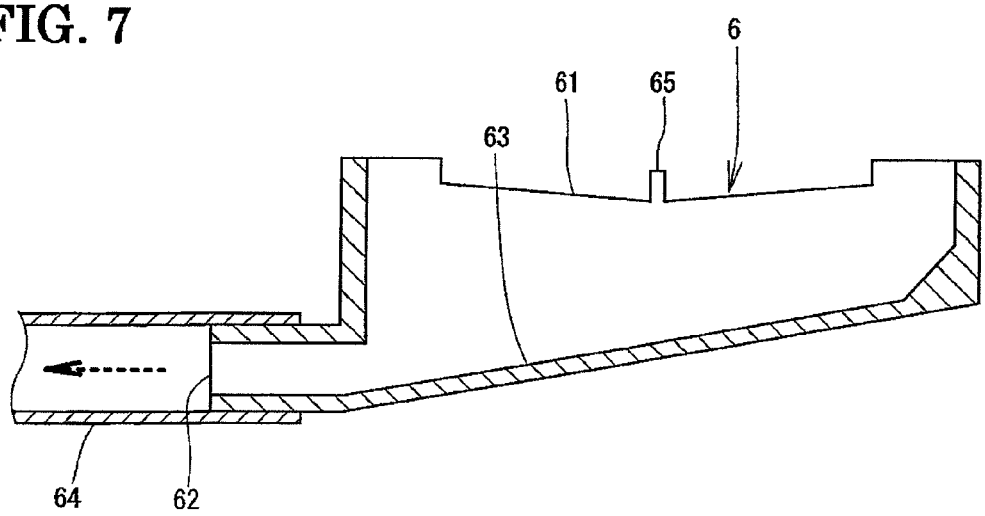
FIG. 7 is a sectional side view showing the configuration of the overflow prevention unit.

As shown in FIG. 6 and FIG. 7, the inlet 61 of the overflow prevention unit 6 is formed on an upper end of the partition wall 44 by partially cutting the partition wall 44, and a protrusion 65 which protrudes vertically upward is formed at a center of the inlet 61. A bottom face 63 of the overflow prevention unit 6 is inclined downward in a predetermined direction, and the outlet 62 is formed on a side wall in the widthwise direction of the washing apparatus 1 in the deepest portion of the overflow prevention unit 6. A flexible resin tube 64 serving as the second exhausting path 12 is connected to the outlet 62 of the overflow prevention unit 6. The tube 64 is arranged along a side wall 45*a* of the tray 4 and led to the transit section 43 provided at lower rear portion of the tray 4. The washing fluid, which flows into the overflow prevention unit 6, flows smoothly along the inclination of the bottom face 63 by gravity, and further flows into the second exhausting path 12. Since the tube 64 is inclined downward from the outlet 62 of the overflow prevention unit 6 to the transit section 43, the washing fluid which flows into the tube flows to the transit section 43 without accumulation in the tube 64.

As is generally known, even when the fluid level of the washing fluid overpasses the height of the partition wall 44, the surface of the washing fluid becomes convex rounded surface by surface tension, and thus, the washing fluid does not flow into the overflow prevention unit 6 immediately. However, according to this embodiment, since the protrusion 65 is further formed on the inlet 61 of the overflow prevention unit 6 which is formed on the partition wall 44, when the convex rounded surface of the washing fluid contacts the protrusion 65, surface tension regionally becomes weak, and thus, the washing fluid starts to flow along the surface of the protrusion 65. Besides, the protrusion 65 is not limited to one protruding vertically upward shown in FIG. 6 and FIG. 7, and it may have another shape such as protruding horizontally inward to the tray 4, for example. In addition, the location of the protrusion 65 is not limited to the center of the inlet 61, and it may be located at another position. Furthermore, a number of the protrusions 65 may be more than one.

Figure 8:
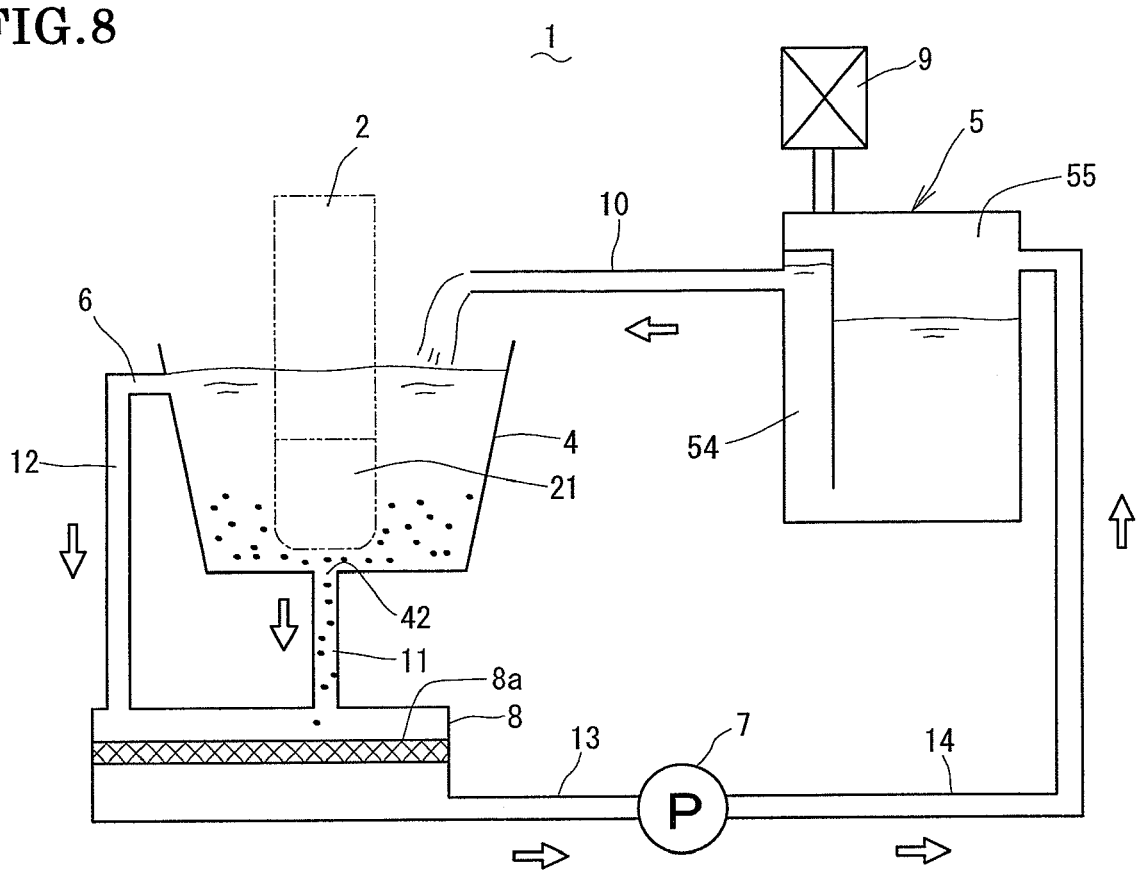
FIG. 8 is an explanation drawing showing a flow of a washing fluid in the washing apparatus.

Subsequently, a washing operation of the above mentioned washing apparatus 1 is described with reference to FIG. 8. FIG. 8 schematically shows the circulation of the washing fluid in the washing operation. Hereupon, when the electric shaver 2 is mounted on the washing apparatus 1, it is assumed that no washing fluid is filled in the tray 4.

When the operation switch 33 (see FIG. 1) is pressed, the switching valve 9 is closed so that the inside of the tank 5 becomes airtight. After that, the pump 7 is started to be driven, so that air is sucked from the filter cartridge 8 through the first returning path 13 by the pump 7 and the sucked air is discharged to the inflow chamber 55 of the tank 5 through the second returning path 14. The fluid level of the washing fluid in the inflow chamber 55 is pushed down by the air discharged into the inflow chamber 55 and the fluid level of the washing fluid in the discharge chamber 54 relatively rises up. When the fluid level of the washing fluid in the discharge chamber 54 reaches to the height of the discharge opening 51, it is started to supply the washing fluid in the discharge chamber 54 to the tray 4 through the supplying path 10. Since a quantity of the washing fluid per a unit time supplied to the tray 4 is set to be larger than a quantity of the washing fluid per the unit time exhausted from the exhausting spout 42 of the tray 4, the tray 4 will be filled by the washing fluid in time.

Hereupon, when the electric contacts 31*a* have the function to transmit predetermined control signal, driving signal is transmitted to the electric shaver 2 through the electric contacts 31*a* at a time when the fluid level of the washing fluid in the tray 4 reaches to a predetermined level (for example, the height of the inlet 61 of the overflow prevention unit 6), so that the built-in motor of the electric shaver 2 is driven. Thereby, beard chips or sebum is washed away from the head portion 21 of the electric shaver 2. The washing fluid including the beard chips or sebum flows into the filter cartridge 8 from the exhausting spout 42 through the first exhausting path 11. In addition, the washing fluid overriding the above mentioned partition wall 44 and flowing into the overflow prevention unit 6 further flows into the filter cartridge 8 from the overflow prevention unit 6 through the second exhausting path 12. The washing fluid flowing into the filter cartridge 8 is filtrated by the filter 8*a* so that the beard chips or sebum is removed from the washing fluid. The pump 7 sucks the washing fluid from the filter cartridge 8 through the first returning path 13 and discharges the washing fluid to the tank 5 through the second returning path 14. Subsequently, circulation of the washing fluid by the pump 7 is continued.

When washing of the head portion 21 of the electric shaver 2 is continued in a predetermined time period, stop signal is transmitted to the electric shaver 2 through the electric contacts 31*a* so that driving of the built-in motor of the electric shaver 2 is stopped. Simultaneously, the switching valve 9 is opened so that inside of the tank 5 becomes opened state to atmosphere. Thereby, the fluid level of the washing fluid in the inflow chamber 55 of the tank 5 rises up and the fluid level of the washing fluid in the discharge chamber 54 falls down, and thus, suppliance of the washing fluid to the tray 4 is stopped. After that, the pump 7 continues the conveyance of the washing fluid to withdraw the remained washing fluid in the tray 4 into the tank 5. When the tray 4 becomes empty, the driving of the pump 7 is stopped, and subsequently, the fan 16 and the heater 17 are driven to dry the head portion 21.

As mentioned above, according to the washing apparatus 1 in accordance with this embodiment, since the outlet 62 of the overflow prevention unit 6 is formed on a side wall in the widthwise direction of the washing apparatus 1, the second exhausting path 12 (tube 64) which connects the outlet 62 of the overflow prevention unit 6 and the filter cartridge 8 can be arranged along the side wall of the tray 4. In other words, it is no need to provide any pipe arrangement below the overflow prevention unit 6, so that design freedom in structure of the washing apparatus 1 is increased and the pump 7 and so on can be disposed in the space below the overflow prevention unit 6 for enabling downsizing of the washing apparatus 1.

In addition, since the bottom face 63 of the overflow prevention unit 6 is inclined downward in a predetermined direction, and the outlet 62 is formed in the deepest portion of the overflow prevention unit 6, the washing fluid flowing into he overflow prevention unit 6 flows smoothly along the inclination of the bottom face 63 by gravity. Furthermore, since the flexible resin tube 64 connected to the outlet 62 of the overflow prevention unit 6 is provided to be curved and inclined downward from the outlet 62 toward a portion below the tray 4, the washing fluid flowing into the tube 64 can flow smoothly without accumulation in the tube 64. Then, the washing fluid which is accelerated by gravity flows into the filter cartridge 8, so that a power of the pump 7 which further discharges the washing fluid from the filter cartridge 8 to the tank 5 can be weaken, and this, downsizing and cost down of the washing apparatus 1 is enabled.

In addition, the present invention is not limited to the configuration of the above mentioned embodiment, and it is possible to modify in various manners within the scope not changing the gist of the invention. For example, the filter cartridge 8 is not necessarily provided between the tray 4 and the tank 5, and the tank 5 may be provided between the tray 4 and the pump 7.

This application is based on Japanese patent application 2009-6830 filed Jan. 15, 2009 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A washing apparatus for washing a head portion of a depilation apparatus comprising:

a tray for holding a head portion of the depilation apparatus;

a washing fluid tank for containing a washing fluid;

a supply path through which the washing fluid is supplied from the tank to the tray;

a first exhaust path for exhausting the washing fluid from an exhausting spout of the tray;

an overflow preventer which is connected to the tray to maintain a fluid level of the washing fluid in the tray at a predetermined level;

a second exhaust path for exhausting the washing fluid flowing into the overflow preventer from an outlet of the overflow preventer; and a pump for supplying the washing fluid to the tray through the supply path and returning the exhausted washing fluid through the first exhaust path and the second exhaust path to the tank, wherein the outlet of the overflow preventer is provided on a side wall of the tray in a widthwise direction of the washing apparatus;

the second exhaust path is arranged along the side wall of the tray in the widthwise direction of the washing apparatus;

the pump is provided below the overflow prevention unit in a vertical direction;

the tank is provided behind the tray in an anteroposterior direction of the washing apparatus;

a filter is provided below the tray in the vertical direction; and a switching valve for controlling a pressure of the tank is provided on the tank, wherein the switching valve is in a closed state when the washing fluid has been discharged from the tank and is otherwise in an open state.

2. The washing apparatus in accordance with claim 1, wherein a bottom face of the overflow preventer is inclined downward in a predetermined direction toward the outlet, and the outlet is provided in a deepest portion of the overflow preventer.

3. The washing apparatus in accordance with claim 2, wherein the overflow preventer is intregral with the tray and adjoins a front of the tray via a partition wall in an anteroposterior direction of the washing apparatus.

4. The washing apparatus in accordance with claim 3, wherein an inlet of the overflow preventer is provided by a partial cut in an upper edge of the partition wall.

5. The washing apparatus in accordance with claim 4, wherein a protrusion is provided at a predetermined position on the inlet of the overflow preventer.

6. The washing apparatus in accordance with claim 1, wherein the overflow preventer is integral with the tray and adjoins a front of the tray via a partition wall in an anteroposterior direction of the washing apparatus.

7. The washing apparatus in accordance with claim 6, wherein an inlet of the overflow preventer is provided by a partial cut in an upper edge of the partition wall.

8. The washing apparatus in accordance with claim 7, wherein a protrusion is provided at a predetermined position on the inlet of the overflow preventer.

9. The washing apparatus in accordance with claim 1, wherein the second exhaust path is curved and inclined downward from the outlet of the overflow preventer toward a portion below the tray.

10. The washing apparatus in accordance with claim 9, wherein the supply path, the first exhaust path, the second exhaust path, and the first return path and the second return path, each comprise flexible resin tubes.

11. The washing apparatus in accordance with claim 1, wherein the tank is detachably provided on the rear end portion of the housing, and has a discharge opening, an inflow entrance and a breather which are formed on the front face of the tank;

the discharge opening is connected to a washing fluid supply spout of the tray via the supply path;

the inflow entrance is connected to an outlet of the pump via a second return path;

the breather is connected to the switching valve via an airtight path;

the discharge opening, the inflow entrance and the breather are provided above the fluid level of the washing fluid to be filled in the tank;

the breather is positioned above the inflow entrance; and the inflow entrance is positioned above the discharge opening.

12. The washing apparatus in accordance with claim 11, wherein the supply path, the first exhaust path, the second exhaust path, the first return path, the second return path and the airtight path each comprise flexible resin tubes.

13. The washing apparatus in accordance with claim 11, wherein a rear end portion of the housing comprises a mounting base on which the washing fluid tank is mounted, and coupling plugs are provided on the mounting base to be coupled with openings of the tank; and the coupling plugs are connected to the supply path, to the second return path, and to the airtight path.

14. The washing apparatus in accordance with claim 13, wherein the tray has a concave shape corresponding to a convex shape of the head portion of the depilation apparatus;

a washing fluid supply spout, connected to the supply path, is provided on a rear wall of the tray, and an exhaust spout, connected to the first exhaust path, is provided on a bottom wall of the tray; and a heater is provided on a rear face of the bottom wall of the tray, and cooperate with a fan to dry the head portion of the depilation apparatus.

15. The washing apparatus in accordance with claim 1, wherein the tray has a concave shape corresponding to a convex shape of the head portion of the depilation apparatus;

a washing fluid supply spout, connected to the supply path, is provided on a rear wall of the tray, and an exhaust spout, connected to the first exhaust path, is provided on a bottom wall of the tray; and a heater is provided on a rear face of the bottom wall of the tray, and cooperate with a fan to dry the head portion of the depilation apparatus.

16. The washing apparatus according to claim 1, wherein the filter is positioned behind the pump in the anteroposterior direction, and the pump is positioned in front of the tray in the anteroposterior direction.

17. The washing apparatus according to claim 1, wherein the filter is positioned under the tray and under the tank.

* * * * *